US009581026B2

(12) United States Patent
Noguchi et al.

(10) Patent No.: US 9,581,026 B2
(45) Date of Patent: Feb. 28, 2017

(54) STEAM TURBINE

(71) Applicant: Kabushiki Kaisha Toshiba, Minato-ku (JP)

(72) Inventors: Taro Noguchi, Suginami (JP); Hiroshi Saeki, Komae (JP); Junichi Tominaga, Yokohama (JP); Shinichiro Ohashi, Ota (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 297 days.

(21) Appl. No.: 14/462,856

(22) Filed: Aug. 19, 2014

(65) Prior Publication Data

US 2015/0063992 A1 Mar. 5, 2015

(30) Foreign Application Priority Data

Aug. 28, 2013 (JP) ..... 2013-176728
May 21, 2014 (JP) ..... 2014-105128

(51) Int. Cl.
*F01D 25/30* (2006.01)
*F01D 1/04* (2006.01)
(Continued)

(52) U.S. Cl.
CPC ..... *F01D 1/04* (2013.01); *F01D 25/00* (2013.01); *F01D 25/24* (2013.01); *F01D 25/246* (2013.01); *F01D 25/30* (2013.01); *F05D 2220/31* (2013.01)

(58) Field of Classification Search
None
See application file for complete search history.

(56) References Cited

U.S. PATENT DOCUMENTS 6,203,274 B1 * 3/2001 Kikuchi ..... F01D 5/02 415/191
6,261,055 B1 * 7/2001 Owczarek ..... F01D 1/02 415/148
(Continued)

FOREIGN PATENT DOCUMENTS

CN 101839148 9/2010
DE 34 30 769 A1 3/1986
(Continued)

OTHER PUBLICATIONS

Extended European Search Report issued Mar. 24, 2015 in Patent Application No. 14181598.5.
(Continued)

*Primary Examiner* — Dwayne J White
*Assistant Examiner* — Justin Seabe
(74) *Attorney, Agent, or Firm* — Oblon, McClelland, Maier & Neustadt, L.L.P.

(57) ABSTRACT

A steam turbine 10 according to an embodiment includes: rotor blade cascades each made up at a turbine rotor 22; an inner casing 21 where the turbine rotor 22 is provided to penetrate; an outer casing 20 surrounding the inner casing 21; stationary blade cascades each made up at an inner side of the inner casing 21; and an annular diffuser 60 provided at a downstream side of a final turbine stage, formed by a steam guide 40 and a bearing cone 50, and discharging steam toward outside in a radial direction. An enlarged inclination angle θ1 of an inner surface 70 of a diaphragm outer ring 26*a* at the final turbine stage relative to a turbine rotor axial direction is an enlarged inclination angle θ2 of an inner surface 80 at an inlet of the steam guide 40 relative to the turbine rotor axial direction or more.

1 Claim, 4 Drawing Sheets

(51) Int. Cl.
*F01D 25/00* (2006.01)
*F01D 25/24* (2006.01)

(56) References Cited

U.S. PATENT DOCUMENTS

| | | | | |
|---|---|---|---|---|
| 7,780,403 | B2 * | 8/2010 | Fridsma | F01D 17/14 415/148 |
| 2010/0232966 | A1 | 9/2010 | Ono et al. | |
| 2012/0163969 | A1 * | 6/2012 | Ongole | F01D 25/30 415/210.1 |

FOREIGN PATENT DOCUMENTS

| | | | |
|---|---|---|---|
| EP | 2 236 754 | A2 | 10/2010 |
| JP | 2010-216321 | | 9/2010 |
| JP | 2011-169172 | A | 9/2011 |
| KR | 10-2012-0124030 | | 11/2012 |
| KR | 10-2014-0025716 | | 3/2014 |

OTHER PUBLICATIONS

Office Action mailed Sep. 5, 2016 in Korean Application No. 10-2015-0074836 (w/English translation).
Korean Office Action issued Jul. 11, 2016 in Patent Application No. 10-2014-0112045 ( with English Translation).

* cited by examiner

STEAM TURBINE

CROSS-REFERENCE TO RELATED APPLICATIONS

This application is based upon and claims the benefit of priority from Japanese Patent Application No. 2013-176728, filed on Aug. 28, 2013; and Japanese Patent Application No. 2014-105128, filed on May 21, 2014; the entire contents of which are incorporated herein by reference.

FIELD

Embodiments described herein relate generally to a steam turbine.

BACKGROUND

Improvement in thermal efficiency of a steam turbine used in a thermal power station and the like has become an important task leading to efficient use of energy resources and a reduction in carbon dioxide ($CO_2$) emission. Effectively converting given energy to mechanical work makes it possible to achieve the improvement in thermal efficiency of a steam turbine. To achieve this, reducing various internal losses is required.

The internal losses of the steam turbine include a profile loss resulting from a blade shape, turbine cascade losses based on a secondary flow loss of steam, a leakage loss of steam, a moisture loss of steam, and so on, passage part losses in passages other than a cascade represented by a steam valve and a crossover pipe, turbine exhaust losses resulting from a turbine exhaust chamber, and so on.

Among these losses, the turbine exhaust loss is a large loss occupying 10% to 20% of all of the internal losses. The turbine exhaust loss is a loss generated from an outlet of a final stage of turbine stages to an inlet of a condenser. The turbine exhaust losses are further classified into a leaving loss, a hood loss, an annular area restriction loss, a turn-up loss, and so on. Among them, the hood loss is a pressure loss from an exhaust chamber to a condenser. The hood loss depends on a type, a shape, and a size of the exhaust chamber including a diffuser.

Generally, the pressure loss increases in proportion to the square of a flow velocity of the steam. Therefore, it is effective to reduce the flow velocity of the steam by increasing the size of the exhaust chamber in an allowable range. However, the increase in the size of the exhaust chamber is restricted by manufacturing cost, arrangement space of a building, and so on. When the size of the exhaust chamber is increased to reduce the hood loss, there are the above-stated restrictions. Besides, the hood loss depends on an axial velocity being a velocity in a turbine rotor axial direction, in other words, a volume flow rate passing through the exhaust chamber.

The hood loss depends on a design of the exhaust chamber including the diffuser. An exhaust chamber of a low-pressure turbine occupies a large capacity in a whole of the steam turbine. Accordingly, the increase in the size of the exhaust chamber to reduce the hood loss largely affects on a whole size and the manufacturing cost of the steam turbine. Therefore, it is important to enable a shape whose pressure loss is small within the limited size of the exhaust chamber.

In a double-flow exhaust type (double flow type) low-pressure turbine including a conventional exhaust chamber in a downward exhaust type, steam passing through a rotor blade of a final turbine stage is led to an annular diffuser made up of a steam guide and a bearing cone. The steam led to the diffuser flows out radially toward outside in a radial direction. A flow of the steam flowing out radially is turned by a casing and so on, and the steam is led to the condenser provided at downward of the steam turbine.

In the low-pressure turbine as stated above, it is important to decelerate the flow at the annular diffuser and to enough recover a static pressure to reduce the pressure loss (static pressure loss) in the exhaust chamber. However, in the low-pressure turbine as stated above, for example, when an inclination angle of an inner surface at an inlet of the steam guide relative to the turbine rotor axial direction is large, the steam separates at a position near an inlet in the diffuser. The separation as stated above remarkably occurs when the flow of the steam cannot be turned moderately in the diffuser, specifically, when a distance of the bearing cone in the turbine rotor axial direction is short.

Conventionally, an attempt to make a shape of a tip part (shroud) of the rotor blade at the final turbine stage into a shape steeply expanding toward outside in the radial direction to thereby suppress the separation of the flow at the steam guide has been done.

However, the suppression of the separation of the flow at the steam guide in the conventional steam turbine is not sufficient. Accordingly, a technology in which the pressure loss in the exhaust chamber is certainly reduced in the steam turbine has been required.

DETAILED DESCRIPTION

In one embodiment, a steam turbine includes: a turbine rotor, rotor blade cascades each made up by implanting plural rotor blades to the turbine rotor in a circumferential direction; an inner casing where the turbine rotor including the rotor blade cascades is provided to penetrate; an outer casing surrounding the inner casing; and stationary blade cascades each made up by attaching plural stationary blades between diaphragm outer rings and diaphragm inner rings provided at an inner side of the inner casing in a circumferential direction, and disposed alternately with the rotor blade cascades in a turbine rotor axial direction.

Further, the steam turbine includes an annular diffuser provided at a downstream side of a final turbine stage from among turbine stages each made up of the stationary blade cascade and the rotor blade cascade at immediate downstream of the stationary blade cascade, formed by a steam guide and a bearing cone at an inner side of the steam guide, and discharging steam passing through the final turbine stage toward outside in a radial direction.

An enlarged inclination angle θ1 of an inner surface of the diaphragm outer ring where an outer periphery of the stationary blade of the final turbine stage is attached relative to the turbine rotor axial direction is an enlarged inclination angle θ2 of an inner surface at an inlet of the steam guide relative to the turbine rotor axial direction or more.

Hereinafter, embodiments of the present invention are described with reference to the drawings.

Figure 1:
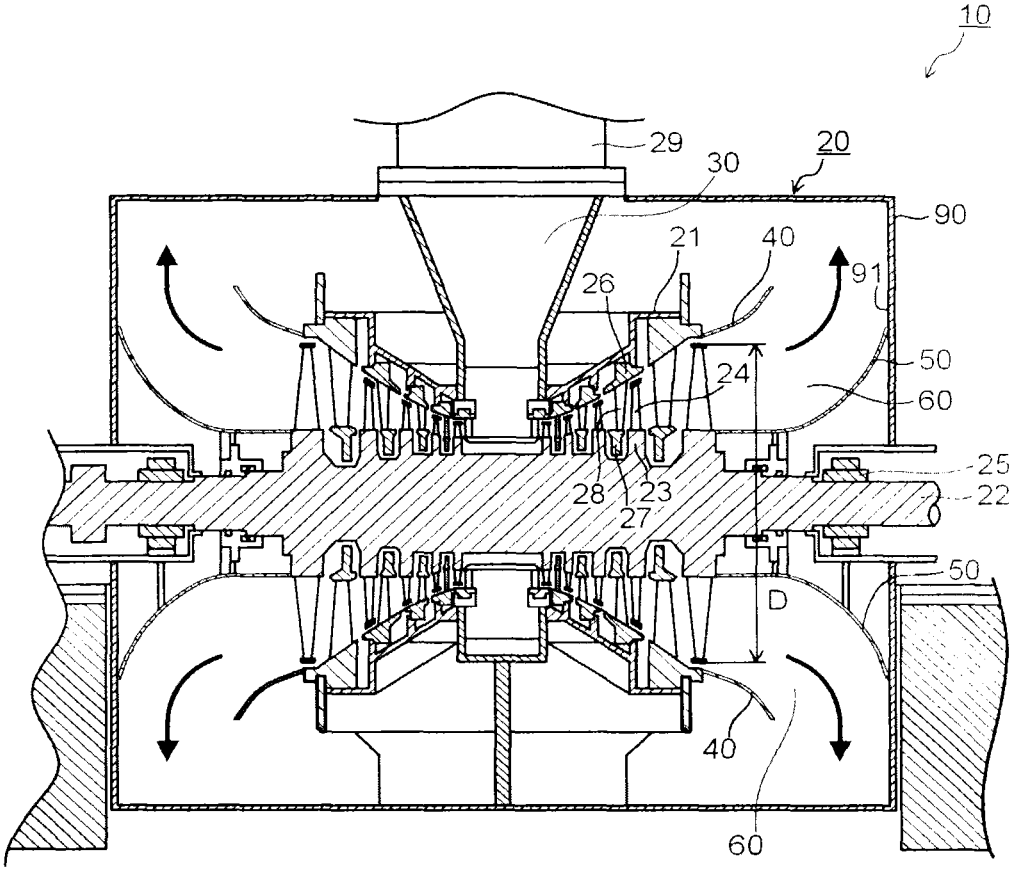
FIG. 1 is a view illustrating a meridian cross section in a vertical direction of a steam turbine according to an embodiment.

FIG. 1 is a view illustrating a meridian cross section in a vertical direction of a steam turbine 10 according to an embodiment. Here, a double-flow exhaust type low-pressure turbine including an exhaust chamber in a downward exhaust type is exemplified to be explained as the steam turbine 10.

As illustrated in FIG. 1, in the steam turbine 10, an inner casing 21 is included in an outer casing 20. A turbine rotor 22 is provided to penetrate in the inner casing 21. At the turbine rotor 22, rotor disks 23 protruding toward outside in a radial direction are formed along a circumferential direction. The rotor disks 23 are formed in plural stages in a turbine rotor axial direction.

Plural rotor blades 24 are implanted to the rotor disk 23 of the turbine rotor 22 in the circumferential direction to make up a rotor blade cascade. The rotor blade cascades are included in plural stages in the turbine rotor axial direction. The turbine rotor 22 is rotatably supported by a rotor bearing 25.

Diaphragm outer rings 26 and diaphragm inner rings 27 are provided at an inner side of the inner casing 21. Plural stationary blades 28 are arranged in the circumferential direction between the diaphragm outer ring 26 and the diaphragm inner ring 27 to make up a stationary blade cascade. The stationary blade cascades are disposed alternately with the rotor blade cascades in the turbine rotor axial direction. The stationary blade cascade and the rotor blade cascade at immediate downstream of the stationary blade cascade make up a turbine stage.

An intake chamber 30 where steam from a crossover pipe 29 is led is included at a center of the steam turbine 10. The steam is distributed and led to the left and right turbine stages from this intake chamber 30.

At a downstream side of the final turbine stage, an annular diffuser 60 is formed by a steam guide 40 at an outer peripheral side and a bearing cone 50 at an inner peripheral side thereof. The annular diffuser 60 discharges the steam toward outside in the radial direction. Note that, for example, the rotor bearing 25 and so on are included at an inner side of the bearing cone 50.

For example, a condenser (not-illustrated) is included at downward of the exhaust chamber in the downward exhaust type including the annular diffuser 60.

Note that the above-stated outer caging 20, the inner casing 21, the steam guide 40, the bearing cone 50, and so on are made up with a structure divided into half at above and below. For example, the cylindrical steam guide 40 is made up by an upper half side and lower half side steam guides 40. Similarly, the cylindrical bearing cone 50 is made up by an upper half side and lower half side bearing cones 50. The annular diffuser 60 is made up by the cylindrical steam guide 40 and the cylindrical bearing cone 50 provided at an inner side thereof. Note that constitutions of the upper half side and lower half side in the steam guide 40 and the bearing cone 50 are the same.

Next, constitutions of the final turbine stage and the annular diffuser 60 are described in detail.

Figure 2:
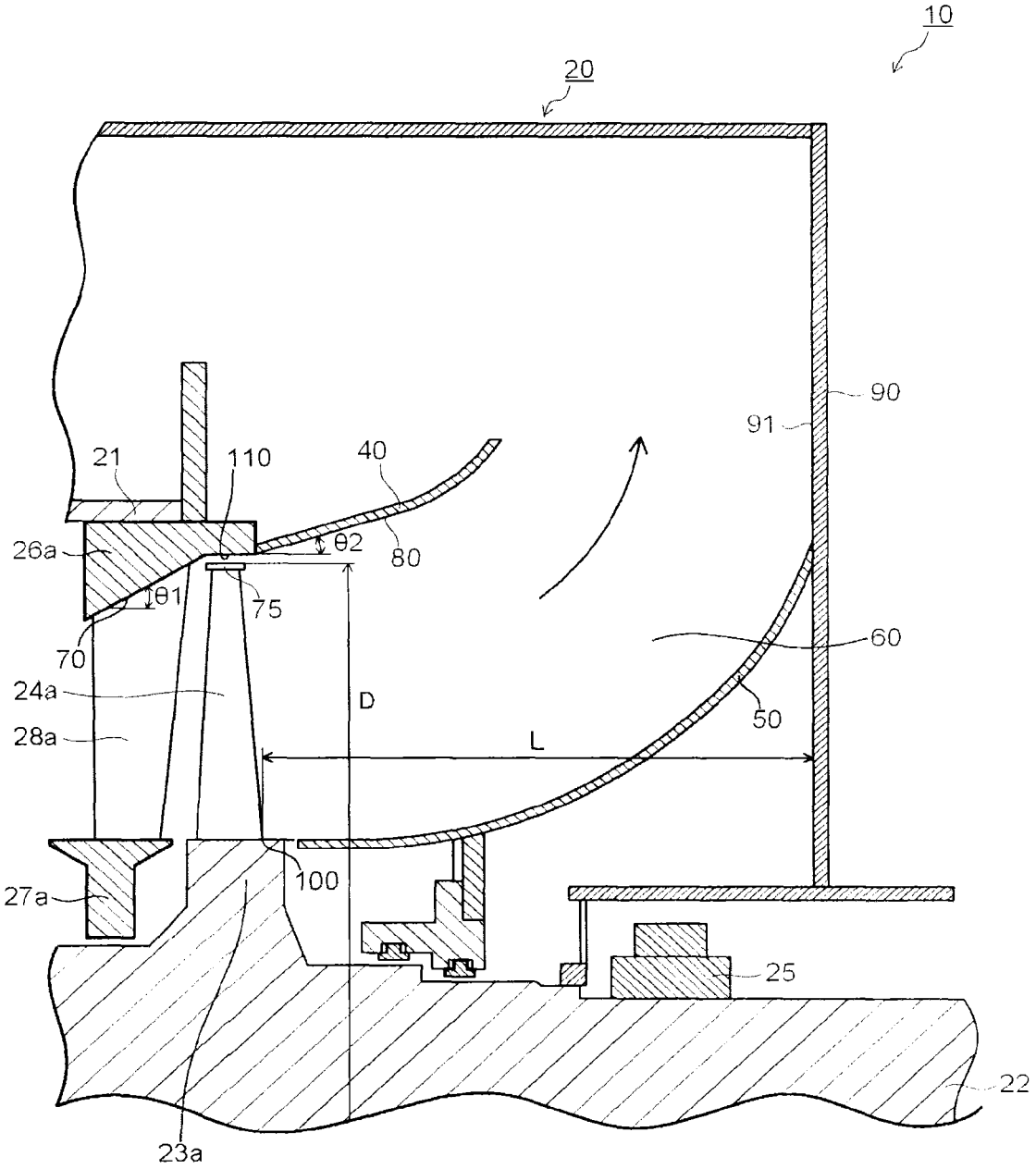
FIG. 2 is a view enlarging a meridian cross section in a vertical direction of a final turbine stage and an annular diffuser at the steam turbine according to the embodiment.

FIG. 2 is a view enlarging a meridian cross section in a vertical direction of the final turbine stage and the annular diffuser 60 at the steam turbine 10 according to the embodiment. Note that in FIG. 2, components of the final turbine stage are represented by adding "a" to each of reference numerals of components illustrated in FIG. 1 for convenience to explain.

As illustrated in FIG. 2, a stationary blade 28*a* of the final turbine stage is attached between a diaphragm outer ring 26*a* and a diaphragm inner ring 27*a*. An inner surface 70 of the diaphragm outer ring 26*a* where an outer periphery of the stationary blade 28*a* is attached expands, for example, linearly toward outside in the radial direction as it goes toward a downstream side in the turbine rotor axial direction. The inner surface 70 inclines at an enlarged inclination angle θ1 relative to the turbine rotor axial direction toward outside in the radial direction as it goes toward the downstream side (right direction in FIG. 2) in the turbine rotor axial direction.

For example, a shroud 75 is included at a tip part of a rotor blade 24*a* at downstream of the stationary blade 28*a*. The shroud 75 is included at the tip part of the rotor blade 24*a*, and thereby, it is possible to suppress instability of flow resulting from vibration at the tip. An inner surface 110 of the diaphragm outer ring 26*a* at a periphery of the rotor blade 24*a* is, for example, approximately horizontal in the turbine rotor axial direction as illustrated in FIG. 2.

Note that the tip part of the rotor blade 24*a*, namely, the shroud 75 is made up to be, for example, approximately horizontal at a cross section illustrated in FIG. 2 so as to keep a distance with the inner surface 110 of the diaphragm outer ring 26*a* constant. The tip part of the rotor blade 24*a* is made to be approximately horizontal in the turbine rotor axial direction along the inner surface 110, and thereby, for example, it is possible to suppress an increase of a leakage steam amount from between the tip part of the rotor blade 24*a* and the inner surface 110 even when a thermal expansion of the turbine rotor 22 in the turbine rotor axial direction occurs. It is thereby possible to stabilize the flow of the steam flowing out of the rotor blade 24*a* and to lead the steam to the annular diffuser 60.

Here, an example in which the shroud 75 is included at the tip part of the rotor blade 24*a* is illustrated, but it may be a constitution in which the shroud 75 is not included at the tip part of the rotor blade 24*a*. When the shroud 75 is not included at the tip part. the tip of the rotor blade 24*a* is made up to be, for example, approximately horizontal at the cross section illustrated in FIG. 2.

The annular diffuser 60 formed by the steam guide 40 and the bearing cone 50 is formed at the downstream side of the final turbine stage.

The bearing cone 50 is made up to be an enlarged cylindrical state widening toward outside in the radial direction as it goes toward the downstream side in the turbine rotor axial direction. An upstream end of the bearing cone 50 is adjacent to an outer part in the radial direction from among a downstream side end face of the rotor disk 23*a* to a degree not to be in contact with the rotating rotor disk 23*a* as illustrated in FIG. 2. A downstream end of the bearing cone 50 is in contact with an inner wall surface 91 of a sidewall 90 of the outer casing 20 at the downstream side in the turbine rotor axial direction.

Here, an example is illustrated in which the bearing cone 50 expands while bending as it goes toward the downstream side in the turbine rotor axial direction. Note that the bearing cone 50 may be a constitution including, for example, a part expanding linearly and a part expanding while bending toward outside in the radial direction as it goes toward the downstream side in the turbine rotor axial direction. Besides, the hearing cone 50 may be a constitution including, for example, plural parts expanding linearly toward outside in the radial direction as it goes toward the downstream side in the turbine rotor axial direction.

The steam guide 40 is constituted to be the enlarged cylindrical state widening toward outside in the radial direction as it goes toward the downstream side in the turbine rotor axial direction. An upstream end of the steam guide 40 is in contact with an inside part in the radial direction from among the downstream side end face of the diaphragm outer ring 26*a* as illustrated in FIG. 2. An upstream part of the steam guide 40 expands, for example, linearly toward outside in the radial direction as it goes toward the downstream side in the turbine rotor axial direction, and a downstream part expands while bending toward outside in the radial direction as it goes toward the downstream side in the turbine rotor axial direction. Note that a shape of the steam guide 40 is not limited thereto. The steam guide 40 may be constituted to be a bugle state expanding while bending toward outside in the radial direction as it goes toward the downstream side in the turbine rotor axial direction from, for example, the upstream end to a downstream end.

An inner surface 80 at an inlet of the steam guide 40 inclines at an enlarged inclination angle θ2 relative to the turbine rotor axial direction toward outside in the radial direction as it goes toward the downstream side in the turbine rotor axial direction as illustrated in FIG. 2. Note that when the steam guide 40 expands while bending toward outside in the radial direction as it goes toward the downstream side in the turbine rotor axial direction from the upstream end to the downstream end, the enlarged inclination angle θ2 is defined by an angle made up of a tangent at an upstream end of the inner surface 80 of the steam guide 40 and the turbine rotor axial direction at the cross section illustrated in FIG. 2.

Here, the enlarged inclination angle θ1 is preferably to be the enlarged inclination angle θ2 or more. The enlarged inclination angles θ1, θ2 are set as stated above, and thereby, the steam flowing out of the final turbine stage flows along the inner surface 80 at the inlet of the steam guide 40. It is thereby possible to prevent a separation of the flow generated at the inner surface 80 of the steam guide 40. In addition, it is possible to suppress reduction in a diffuser performance at the annular diffuser 60.

A distance from a most downstream end 100 at a root of the rotor blade 24*a* to the inner wall surface 91 of the sidewall 90 where the downstream end of the bearing cone 50 is in contact is set to be L, and an outer diameter of the rotor blade 24*a* is set to be D. Here, the outer diameter D is equal to a diameter of a circle drawn by a blade tip of the rotor blade 24*a* when the rotor blade 24*a* rotates. Note that when the rotor blade 24*a* includes the shroud 75, the outer diameter D is an outer diameter including the shroud 75 as illustrated in FIG. 1 and FIG. 2. To secure the diffuser performance, for example, it is preferable to set the enlarged inclination angles θ1, θ2 in accordance with a ratio (L/D) between the distance L and the outer diameter D.

Here, L/D is preferably set to be 0.2 or more and 0.6 or less. When L/D is lower than 0.2, a pressure loss resulting from the separation of the flow (hereinafter, referred to as a separation loss) generating at the inner surface 80 of the steam guide 40 occurs when "the enlarged inclination angle θ1−the enlarged inclination angle θ2" is "0" (zero) degree or more. On the other hand, when L/D exceeds 0.6, a size of the exhaust chamber increases.

It is preferable that a following relational expression (1) is satisfied when (L/D) is within a range of 0.2 or more and 0.6 or less.

$$0 \leq \text{enlarged inclination angle } \theta 1 - \text{enlarged inclination angle } \theta 2 \leq 40(L/D) - 4 \qquad \text{expression (1)}$$

Note that a unit of the above-stated relational expression is a degree.

When "the enlarged inclination angle θ1−the enlarged inclination angle θ2" is lower than "0" (zero) degree, the separation loss occurs. On the other hand, when "the enlarged inclination angle θ1−the enlarged inclination angle θ2" exceeds "40(L/D)−4", the pressure loss resulting from bending of the annular diffuser 60 toward outside in the radial direction (hereinafter, referred to as a bending loss) occurs.

As stated above, the enlarged inclination angles θ1, θ2 are set to satisfy the above-stated expression (1) in accordance with (L/D), and thereby, it is possible to prevent the separation loss and the bending loss. It is thereby possible to suppress the reduction in the diffuser performance at the annular diffuser 60.

Here, operations of the steam turbine 10 are described with reference to FIG. 1 and FIG. 2.

The steam flowing into the intake chamber 30 in the steam turbine 10 via the crossover pipe 29 branches and flows to the left and right turbine stages. The steam passes through a steam flow passage including the stationary blades 28 and the rotor blades 24 of each turbine stage while performing expansion work to rotate the turbine rotor 22. The steam passing through the final turbine stage flows into the annular diffuser 60.

Here, the steam flowing along the inner surface 70 of the diaphragm outer ring 26*a* also flows at an inlet of the annular diffuser 60 with the enlarged inclination angle θ1 of the inner surface 70. Accordingly, when the steam passing through the final turbine stage flows into the annular diffuser 60, the steam flows along the inner surface 80 of the steam guide 40 without being separated. The flow is decelerated by the annular diffuser 60.

Besides, when the steam flows in a bending flow passage in the annular diffuser 60, the steam flows without generating the bending loss. Accordingly, the static pressure is enough recovered at the annular diffuser 60.

At an outlet of the annular diffuser 60, the steam flows out toward outside in the radial direction. The flow of the steam flowing toward outside in the radial direction is turned toward downward. The turned steam is led to, for example, a condenser (not-illustrated) provided at downward of the turbine rotor 22.

Note that, here, an example in which the condenser (not-illustrated) is provided at downward of the turbine rotor 22 is illustrated, but the condenser may be included at, for example, a lateral side of the steam turbine 10 in a vertical and horizontal direction of the turbine rotor axial direction. In other words, the steam turbine 10 may be one in a lateral exhaust type without being limited to the downward exhaust type.

As stated above, according to the steam turbine 10 of the embodiment, the enlarged inclination angles θ1, θ2 are set in accordance with the ratio (L/D) between the distance L and the outer diameter D of the rotor blade 24*a*, and thereby, it is possible to suppress the separation loss and the bending loss at the annular diffuser 60 of the exhaust chamber. It is thereby possible to reduce the pressure loss at the exhaust chamber.

Figure 3:
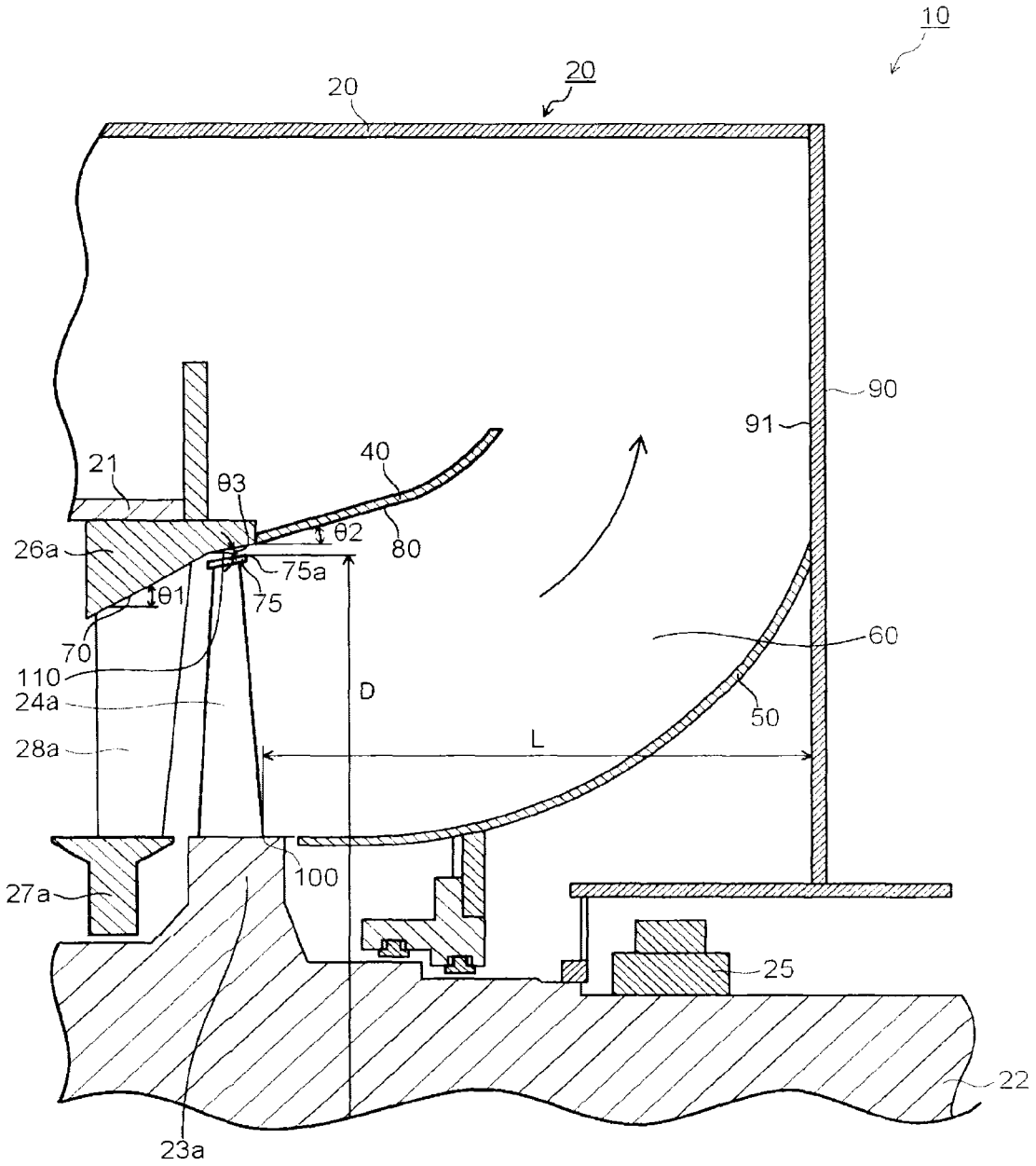
FIG. 3 is a view enlarging a meridian cross section in a vertical direction of a final turbine stage and an annular diffuser having another configuration at the steam turbine according to the embodiment.

Note that the steam turbine 10 of the embodiment is not limited to the above-stated constitution. FIG. 3 is a view enlarging a meridian cross section in a vertical direction of the final turbine stage and the annular diffuser 60 having another configuration at the steam turbine 10 according to the embodiment. Note that in FIG. 3, components of the final turbine stage are represented by adding "a" to each of reference numerals of components illustrated in FIG. 1 for convenience to explain.

As illustrated in FIG. 3, the inner surface 110 of the diaphragm outer ring 26*a* at the periphery of the rotor blade 24*a* at the final turbine stage may be constituted to expand, for example, linearly toward outside in the radial direction as it goes toward the downstream side in the turbine rotor axial direction. The inner surface 110 inclines at an enlarged inclination angle θ3 relative to the turbine rotor axial direction toward outside in the radial direction as it goes toward the downstream side (right direction in FIG. 3) in the turbine rotor axial direction.

In this case, a distance between the shroud 75 at the tip part of the rotor blade 24*a* and the inner surface 110 of the diaphragm outer ring 26*a* is kept constant. Accordingly, the shroud 75 is, for example, provided to incline at the enlarged inclination angle θ3 relative to the turbine rotor axial direction toward outside in the radial direction as it goes toward the downstream side in the turbine rotor axial direction as illustrated in FIG. 3. When the shroud 75 as stated above is included, the outer diameter D of the rotor blade 24*a* is equal to a diameter of a circle drawn by a most tip part 75*a* of the shroud 75 in the radial direction when the rotor blade 24*a* rotates as illustrated in FIG. 3. Note that the most tip part 75*a* of the shroud 75 in the radial direction is an end part at outside in the radial direction of the shroud 75 at a most downstream side.

Here, it is preferable that the enlarged inclination angle θ3 satisfies a relationship of a following expression (2) without depending on the ratio (L/D) between the distance L and the outer diameter D of the rotor blade 24*a*.

$$0 < \text{enlarged inclination angle } \theta 3 \leq \text{enlarged inclination angle } \theta 1 + 5 \qquad \text{expression (2)}$$

Note that a unit of the above-stated relational expression is a degree.

The enlarged inclination angle θ3 is set to be within this range, and thereby, the steam flowing along the inner surface 70 of the diaphragm outer ring 26*a* flows with the enlarged inclination angle θ1 of the inner surface 70 after passing through the inner surface 110. Namely, the steam flowing along the inner surface 70 of the diaphragm outer ring 26*a* flows with the enlarged inclination angle θ1 of the inner surface 70 also at the inlet of the annular diffuser 60. Accordingly, when the steam passing through the final turbine stage flows into the annular diffuser 60, the steam flows along the inner surface 80 of the steam guide 40 without being separated. The flow is decelerated by the annular diffuser 60. It is thereby possible to obtain an operation and effect similar to the operation and effect in the constitution illustrated in FIG. 2.

Note that in the above-stated embodiment, the double-flow exhaust type low-pressure turbine including the exhaust chamber in the downward exhaust type is exemplified to be described as the steam turbine 10, but the present embodiment is able to apply for, for example, a single-flow type low-pressure turbine.

(Evaluation of Diffuser Performance)

Here, conditions when the separation loss, the bending loss are generated are studied from the relationship of "the ratio (L/D) between the distance L and the outer diameter D of the rotor blade 24*a*" and "the enlarged inclination angle θ1−the enlarged inclination angle θ2".

Here, the constitution illustrated in FIG. 2 is used as a model of the steam turbine to be evaluated. Namely, the inner surface 110 of the diaphragm outer ring 26*a* at the periphery of the rotor blade 24*a* is made to be horizontal relative to the turbine rotor axial direction as illustrated in FIG. 2.

Figure 4:
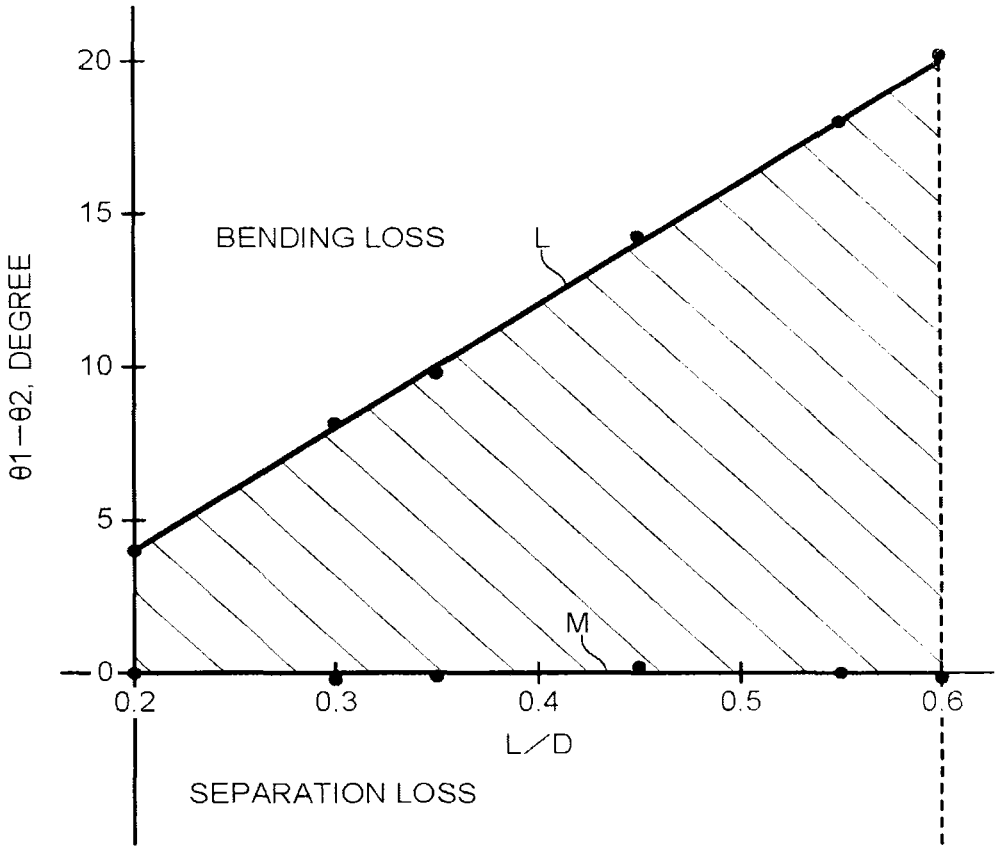
FIG. 4 is a view illustrating a result in which areas where a separation loss, a bending loss occur are found from a relationship between (L/D) and "θ1−θ2".

FIG. 4 is a view illustrating a result in which areas where the separation loss, the bending loss occur are found from the relationship between (L/D) and "θ01−θ2". Note that FIG. 4 is a result found by a numerical analysis.

In FIG. 4, a line L is a line in which angles of "θ1−θ2" at a boundary where the bending loss does not occur when "θ1−θ2" is changed under plural different (L/D) conditions are plotted and approximated. The bending loss occurs at upward of this line, namely, under a condition in which "θ1−θ2" is larger than the line. In other words, at an area on the line and at downward of the line, the bending loss does not occur. This line L is represented by a relational expression of "θ1−θ2=40(L/D)−4".

A line M is a line in which angles of "θ1−θ2" at a boundary where the separation loss does not occur when "θ1−θ2" is changed under plural different (L/D) conditions are plotted and approximated. The separation loss occurs at downward of this line, namely, under a condition in which "θ1−θ2" is smaller than the line. In other words, at an area on the line and at upward of the line, the separation loss does not occur. This line M is represented by "θ1−θ2=0".

Note that the range of (L/D) is set to be 0.2 or more and 0.6 or less as stated above, and the conditions in which the separation loss and the bending loss occur are evaluated within the range. In FIG. 4, an area where both the separation loss and the bending loss do not occur is represented by oblique lines.

As illustrated in FIG. 4, it turns out that both the separation loss and the bending loss do not occur at a range surrounded by the line L and the line M when (L/D) is within the range of 0.2 or more and 0.6 or less. This range is a range satisfying the relationship of the expression (1).

As stated above, at the range surrounded by the line L and the line M, the separation loss and the bending loss do not occur, and therefore, it is possible to constitute the annular diffuser 60 having excellent diffuser performance.

According to the above-stated embodiment, it is possible to suppress the separation of the flow at the exhaust chamber and to reduce the pressure loss.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam turbine comprising:

a casing;

a turbine rotor penetrating into the casing;

a plurality of turbine stages, each of the plurality of turbine stages having a respective stationary blade cascade and a respective rotor blade cascade, the respective rotor blade cascade including plural rotor blades implanted in a circumferential direction to the turbine rotor, the respective rotor blade cascade being positioned immediately downstream of the respective stationary blade cascade, the plurality of turbine stages including a final turbine stage located at a downstream end of the plurality of turbine stages;

diaphragm outer rings and diaphragm inner rings provided at an inner side of the casing, each of the stationary blade cascades being provided between a respective diaphragm outer ring and a respective diaphragm inner ring; and an annular diffuser provided at a downstream side of the final turbine stage, the annular diffuser having a steam guide and a bearing cone at an inner side of the steam guide, the annular diffuser discharging steam passing through the final turbine stage toward outside in a radial direction, wherein an enlarged inclination angle (θ1) of an inner surface of the diaphragm outer ring where an outer periphery of a stationary blade at the final turbine stage is attached relative to a turbine rotor axial direction, is greater than or equal to an enlarged inclination angle (θ2) of an inner surface at an inlet of the steam guide relative to the turbine rotor axial direction, wherein a following relational expression is satisfied when a ratio (L/D) between a distance (L) from a most downstream end at a root of a rotor blade at the final turbine stage to an inner surface of a downstream side sidewall of the outer casing where an end part at a downstream side of the bearing cone is in contact and an outer diameter (D) of the rotor blade at the final turbine stage is within a range of 0.2 or more and 0.6 or less, $$0 \leq \text{enlarged inclination angle } \theta 1 \text{ (degree)} - \text{enlarged inclination angle } \theta 2 \text{ (degree)} \leq 40(L/D) - 4.$$

* * * * *